US011691179B2

(12) United States Patent
Salminen

(10) Patent No.: US 11,691,179 B2
(45) Date of Patent: Jul. 4, 2023

(54) MOBILE MINERAL MATERIAL PROCESSING STATION

(71) Applicant: Metso Outotec Finland Oy, Tampere (FI)

(72) Inventor: Vesa-Matti Salminen, Tampere (FI)

(73) Assignee: Metso Outotec Finland Oy, Tampere (FI)

( * ) Notice: Subject to any disclaimer, the term of this patent is extended or adjusted under 35 U.S.C. 154(b) by 0 days.

(21) Appl. No.: 17/415,387

(22) PCT Filed: Dec. 19, 2019

(86) PCT No.: PCT/FI2019/050911

§ 371 (c)(1),
(2) Date: Jun. 17, 2021

(87) PCT Pub. No.: WO2020/128165

PCT Pub. Date: Jun. 25, 2020

(65) Prior Publication Data

US 2022/0062951 A1 Mar. 3, 2022

(30) Foreign Application Priority Data

Dec. 21, 2018 (FI) ..... 20186127

(51) Int. Cl.
*B07B 1/00* (2006.01)
*B07B 1/42* (2006.01)
*B07B 13/16* (2006.01)

(52) U.S. Cl.
CPC ..... *B07B 1/42* (2013.01); *B07B 1/005* (2013.01); *B07B 13/16* (2013.01)

(58) Field of Classification Search
CPC ..... B07B 1/005; B07B 1/28; B07B 13/16
See application file for complete search history.

(56) References Cited

U.S. PATENT DOCUMENTS 3,439,806 A 4/1969 Kass et al.
4,981,204 A 1/1991 Smith
(Continued)

FOREIGN PATENT DOCUMENTS

BE 1010451 A6 8/1998
CN 104093501 A 10/2014
(Continued)

OTHER PUBLICATIONS

Search Report issued in the Finnish priority Application No. 20186127 dated Jul. 5, 2019.

(Continued)

*Primary Examiner* — Joseph C Rodriguez
(74) *Attorney, Agent, or Firm* — Andrus Intellectual Property Law, LLP

(57) ABSTRACT

A mobile mineral material processing station has a mobile platform having tracks or wheels or a skids for supporting or forming a body that supports in line, in a transport configuration: a feed conveyor; a screen frame and a multi-layer screen; first and second exit conveyors; and a third exit conveyor on top of the first and second exit conveyors. The first exit conveyor turns from a transport position, under the third exit conveyor, to a first operation direction, onto a first side of the station, for operating the station, and back. The second exit conveyor turns from a transport position, under the third exit conveyor, to a second operation direction onto a second side of the station, opposite to the first side, and back.

13 Claims, 1 Drawing Sheet

(56) References Cited

U.S. PATENT DOCUMENTS

| | | | | |
|---|---|---|---|---|
| 6,186,338 | B1 | 2/2001 | Douglas | |
| 6,698,594 | B2 * | 3/2004 | Cohen | B07B 1/005 209/421 |
| 7,461,746 | B1 * | 12/2008 | Egge | B08B 3/042 209/268 |
| 8,783,443 | B2 * | 7/2014 | Erkkila | B07B 1/005 198/510.1 |
| 9,694,363 | B2 * | 7/2017 | Salminen | B02C 23/08 |
| 11,033,933 | B2 * | 6/2021 | Rafferty | B07B 13/16 |
| 11,078,024 | B2 * | 8/2021 | Geywitz | B65G 65/005 |
| 11,247,237 | B2 * | 2/2022 | Rafferty | B07B 13/16 |
| 11,305,317 | B2 * | 4/2022 | Belosevic | B07B 1/005 |
| 11,376,631 | B2 * | 7/2022 | Kykyri | B07B 1/005 |
| 2019/0160492 | A1 * | 5/2019 | Kruse | B07B 1/46 |

FOREIGN PATENT DOCUMENTS

| | | | |
|---|---|---|---|
| CN | 204602610 | U | 9/2015 |
| CN | 105517712 | A | 4/2016 |
| EA | 014343 | B1 | 10/2010 |
| EP | 2359944 | | 2/2011 |
| GB | 1205874 | A | 9/1970 |
| GB | 1480688 | A | 7/1977 |
| GB | 2309923 | | 8/1997 |
| GB | 2526769 | A | 12/2015 |
| JP | S6017279 | U | 2/1985 |
| JP | 2012200655 | A | 10/2012 |
| RU | 128522 U1052013 | | 5/2013 |
| RU | 2641156 | C2 | 1/2018 |
| WO | 9512462 | A1 | 5/1995 |
| WO | 9741971 | A1 | 11/1997 |
| WO | 0226403 | | 4/2002 |
| WO | 2013102699 | A1 | 7/2013 |

OTHER PUBLICATIONS

International Search Report and Written Opinion for International Application No. PCT/FI2019/050911 dated Mar. 17, 2020.
Search Report and Office action issued in the Chinese Application No. 201980083192.8 dated Aug. 1, 2022.
Office Action and Search Report for Russian Patent Application No. 2021118586, dated Apr. 13, 2023.

* cited by examiner

MOBILE MINERAL MATERIAL PROCESSING STATION

CROSS-REFERENCE TO RELATED APPLICATIONS

This application is the U.S. national stage application of International Application PCT/FI2019/050911, filed Dec. 19, 2019, which international application was published on Jun. 25, 2020, as International Publication WO 2020/128165 A1 in the English language. The International Application claims priority of Finnish Patent Application No. 20186127 filed Dec. 21, 2018.

TECHNICAL FIELD

The present invention generally relates to a mobile mineral material processing station. The invention relates particularly, though not exclusively, transformation of the mobile mineral material processing station between compacted transportation configuration and extended operating configuration.

BACKGROUND ART

This section illustrates useful background information without admission of any technique described herein representative of the state of the art.

Mineral material is processed by screening or crushing with mobile stations that are self-propelled or towable. Mobility of such stations is improved by compacting to a transport configuration. GB 2526769 A presents an example of a mobile screening apparatus for handling bulk material and especially in a portable or mobile format. The apparatus of GB 2526769 A has a feed conveyor and screen that can be brought to overlap and tilt upwards by their adjacent ends and also three exit conveyors, two of which can be folded onto the screen so that the entire apparatus is largely compacted for ease of transportation. The foldable side conveyors appear to be manually foldable and there are rectangular profiled telescopic supports for holding the foldable side conveyors in an extended configuration. A central exit conveyor is fixedly mounted.

It is an object of the invention to enhance portability of a mobile mineral material processing station or to improve an operating configuration of the mobile mineral material processing station or to at least provide a new technical alternative.

SUMMARY

According to a first example aspect of the invention there is provided a mobile mineral material processing station comprising:

- a mobile platform comprising tracks or wheels or a skids;
- a frame supported by or formed by the mobile platform;
- supported by the frame in line: a screen; and an exit conveyor; and
- at least one actuator configured to tilt the screen in a first rotational direction.

The mobile mineral material processing station is characterized by a tilting mechanism configured to tilt the exit conveyor, synchronized with the screen, in a second rotational direction opposite to the first rotational direction when the actuator tilts the screen in the first rotational direction.

The mobile mineral material processing station may further comprise a feed conveyor. The feed conveyor may be supported by the frame in line with the screen and exit conveyor. The tilting mechanism may be configured to tilt the feed conveyor and the exit conveyor synchronized with the screen in the second rotational direction opposite to the first rotational direction when the actuator tilts the screen in the first rotational direction.

The tilting mechanism may be further configured maintain the exit conveyor at a distance from the screen that remains constant during the tilting of the exit conveyor.

The mobile platform may comprise tracks. The mobile platform may comprise wheels. The mobile platform may comprise skids.

The at least one actuator may comprise or be a linear actuator. The at least one actuator may comprise or be a hydraulic actuator. The at least one actuator may comprise or be a pneumatic actuator. The at least one actuator may comprise or be an electric hydraulic actuator.

The tilting mechanism may comprise feed conveyor tilting arms. The tilting mechanism may comprise exit conveyor tilting arms. The feed conveyor tilting arms may comprise a first sub-arm and a second sub-arm that are pivotably connected to each other. The first sub-arm may be functionally connected to the screen to move with the screen. The second sub-arm may be functionally connected to the feed conveyor to move with feed conveyor. The actuator may be connected to the first sub-arm.

The tilting mechanism may be configured to tilt the feed conveyor and the exit conveyor by angles deviating at most 1 degree, 5 degrees, 10 degrees, 15 degrees or 20 degrees.

The tilting of the screen in the first rotational direction may increase sloping down of the screen away from the feed conveyor.

The screen may be rotated from a compacted orientation to an operating orientation by the tilting in the first rotational direction. The compacted orientation may be parallel with a ground line of the mobile platform. The ground line may be ground-facing parts of the mobile platform when seen from a side perpendicularly to longitudinal direction of the mobile mineral material processing station.

The feed conveyor may be rotated from a compacted orientation to an operating orientation by the tilting in the second rotational direction. The compacted orientation may be parallel with a ground line of the mobile platform or deviate from the parallel with the ground line by at most 1 degree, 5 degrees, 10 degrees or 15 degrees.

The exit conveyor may be rotated from a compacted orientation to an operating orientation by the tilting in the second rotational direction. The compacted orientation may be parallel with a ground line of the mobile platform.

Advantageously, the mechanism provides that the tail end of the conveyor follows the screen when screen angle is changed. This reduces problems related on varying distance between the screen and the conveyor. Also transport height may be lowered without costly separate mechanism.

According to a second example aspect of the invention there is provided a method in a mobile mineral material processing station comprising a mobile platform having tracks or wheels or a skids, the method comprising:

- supporting or forming a frame by the mobile platform;
- supporting by the frame in line: a screen; and an exit conveyor; and
- tilting by at least one actuator the screen in a first rotational direction.

The method is characterized by tilting by a tilting mechanism the exit conveyor, synchronized with the screen, in a second rotational direction opposite to the first rotational direction when the actuator tilts the screen in the first rotational direction.

Different non-binding example aspects and embodiments of the present invention have been illustrated in the foregoing. The embodiments in the foregoing are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

Some example embodiments of the invention will be described with reference to the accompanying drawings, in which.

DETAILED DESCRIPTION

In the following description, like reference signs denote like elements or steps.

Figure 1:
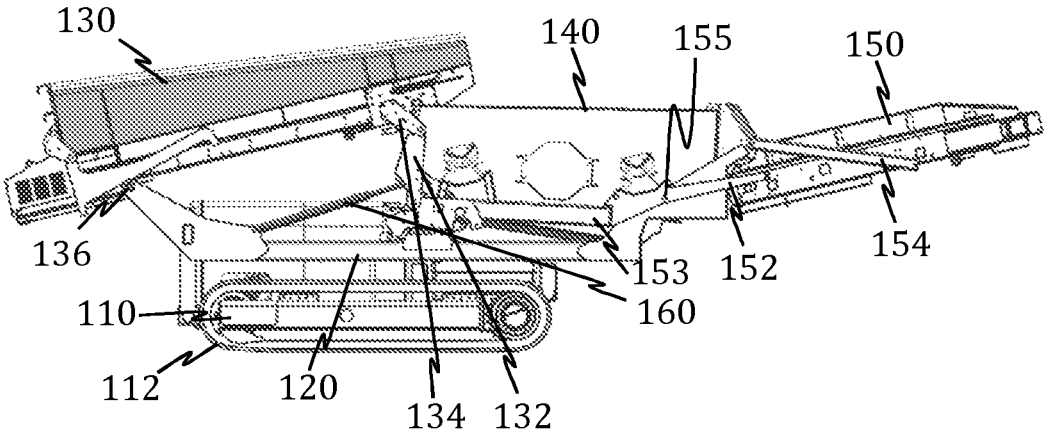
FIG. 1 shows in a partly extended configuration a mobile mineral material processing station.

FIG. 1 shows in a partly extended configuration a mobile mineral material processing station 100, or station 100 in short. The station comprises:

- a mobile platform 110 comprising tracks 112 or wheels or a skids;
- a frame 120 supported by or formed by the mobile platform;
- supported by the frame 120 in line: an optional feed conveyor 130; a screen 140; and an exit conveyor 150;
- at least one actuator 160 configured to tilt the screen 140 in a first rotational direction; and
- a tilting mechanism 132, 134, 136, 152, 154 configured to tilt the feed conveyor 130 (optional) and the exit conveyor 150 synchronized with the screen 140 in a second rotational direction opposite to the first rotational direction when the actuator 160 tilts the screen 140 in the first rotational direction.

The tilting mechanism 132, 134, 136, 152, 154 of FIG. 1 comprises:

- a first sub-arm 132 and a second sub-arm 134 that are pivotably connected to each other and together link the feed conveyor 130 to the screen 140;
- a sliding support 136 for another end of the feed conveyor 130;
- a lower arm 152 fixedly connected to a sub frame 153 of the screen 140 and extending to pivotably connect with a receiving end of the exit conveyor 150;
- the sub frame 153 is pivotably 155 connected to the frame 120
- a body arm 154 for suspending the exit conveyor 150 from a pivot point fixed in relation to the frame 120.

In an embodiment, the exit conveyor 150 is maintained by the tilting mechanism at a constant distance from the screen 140.

In FIG. 1, there are two actuators 160 at both sides of the station 100. The actuators 160 of FIG. 1 are linear actuators such as hydraulic or pneumatic cylinders. Furthermore, in the station 100 of FIG. 1, there the drawn parts of the tilting mechanism are provided on both sides of the station 100.

The actuators 160 of FIG. 1 are connected to the first sub-arms 132 of the same side of the station 100 so that all of the feed conveyor 130, screen 140 and the exit conveyor 150 can be retracted in line and in a succession one after another and then extended again so that the tilting mechanism tilts also all of the feed conveyor 130, screen 140 and the exit conveyor 150 simultaneously and synchronously. A discharging end of the exit conveyor 150 is lifted by the tilting mechanism higher up so that bigger piles can be formed or direct loading to trucks is facilitated, whereas the retracted configuration can still be maintained relatively low for facilitating transport.

The tilting mechanism may be configured to tilt the feed conveyor and the exit conveyor by angles deviating at most 1 degree, 5 degrees, 10 degrees, 15 degrees or 20 degrees.

The tilting of the screen 140 in the first rotational direction may increase sloping down of the screen 140 away from the feed conveyor.

Figure 2:
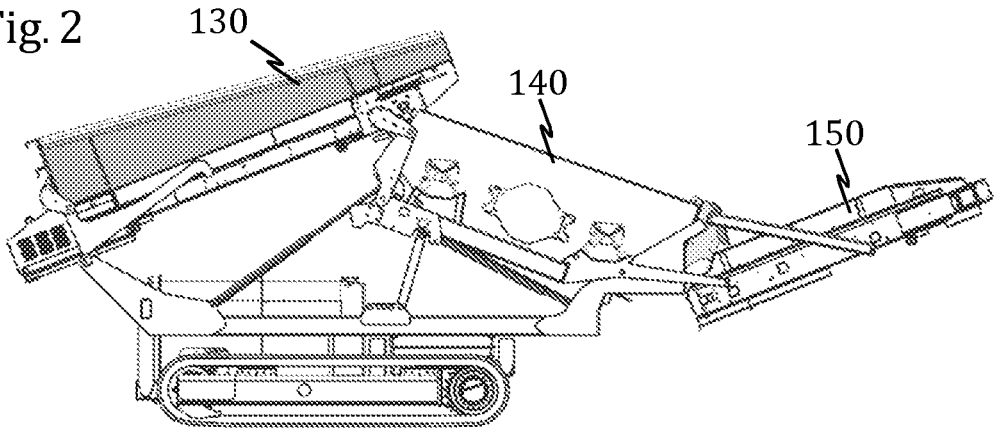
FIG. 2 shows the mobile mineral material processing station in an operating configuration.

FIG. 2 shows the station 100 in an operating configuration in which the screen 140 has been rotated from a compacted orientation to an operating orientation by tilting in the first rotational direction. As shown in FIG. 1, the compacted orientation can be parallel with a ground line of the mobile platform or deviate from the parallel by at most by 1 degree, 5 degrees, 10 degrees or 15 degrees.

FIG. 2 also shows that the feed conveyor 130 has been rotated from a compacted orientation to an operating orientation by the tilting in the second rotational direction and that the exit conveyor 150 has been rotated from a compacted orientation to an operating orientation by the tilting in the second rotational direction.

Various embodiments have been presented. It should be appreciated that in this document, words comprise, include and contain are each used as open-ended expressions with no intended exclusivity.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A mobile mineral material processing station comprising:

- a mobile platform;
- a frame supported by or formed by the mobile platform;
- a screen supported by the frame and having an upstream end and a downstream end;
- an exit conveyor supported by the frame and positioned in line with the screen and located adjacent the downstream end of the screen;
- at least one actuator configured to tilt the upstream end of the screen in a first rotational direction; and
- a tilting mechanism configured to tilt the exit conveyor, synchronized with tilting of the screen, in a second rotational direction opposite to the first rotational direction when the at least one actuator tilts the screen in the first rotational direction.

2. The mobile mineral material processing station of claim 1, wherein the tilting mechanism is further configured maintain the exit conveyor at a distance from the downstream end of the screen that remains constant during the tilting of the exit conveyor.

3. The mobile mineral material processing station of claim 1, wherein:

the mobile mineral material processing station further comprises a feed conveyor; and the feed conveyor is supported by the frame in line with the screen and the exit conveyor.

4. The mobile mineral material processing station of claim 3, wherein the tilting mechanism is configured to tilt the feed conveyor and the exit conveyor synchronized with the tilting of the screen in the second rotational direction opposite to the first rotational direction when the actuator tilts the screen in the first rotational direction.

5. The mobile mineral material processing station of claim 1, wherein:

the tilting mechanism comprises feed conveyor tilting arms which comprise a first sub-arm and a second sub-arm that are pivotably connected to each other;

the first sub-arm is functionally connected to the screen to move with the screen; and the second sub-arm is functionally connected to the feed conveyor to move with feed conveyor.

6. The mobile mineral material processing station of claim 5, wherein the actuator is connected to the first sub-arm.

7. The mobile mineral material processing station of claim 1, wherein the tilting mechanism is configured to tilt the feed conveyor and the exit conveyor by angles deviating at most 20 degrees.

8. The mobile mineral material processing station of claim 1, wherein the tilting of the screen in the first rotational direction increases sloping down of the screen away from the feed conveyor.

9. The mobile mineral material processing station of claim 1, wherein the screen is rotated from a compacted orientation to an operating orientation by the tilting in the first rotational direction.

10. The mobile mineral material processing station of claim 1, wherein the feed conveyor is rotated from a compacted orientation to an operating orientation by the tilting in the second rotational direction.

11. The mobile mineral material processing station of claim 1, wherein the exit conveyor is rotated from a compacted orientation to an operating orientation by the tilting in the second rotational direction.

12. The mobile mineral material processing station of claim 9, wherein the compacted orientation is parallel with a ground line of the mobile platform.

13. A method in a mobile mineral material processing station comprising a mobile platform having tracks or wheels or a skids, the method comprising:

supporting or forming a frame by the mobile platform;

supporting a screen by the frame, the screen having an upstream end and a downstream end;

supporting an exit conveyor by the frame in line with the screen and adjacent to the downstream end of the screen;

tilting by at least one actuator the upstream end of the screen in a first rotational direction; and tilting by a tilting mechanism the exit conveyor, synchronized with the tilting of the screen, in a second rotational direction opposite to the first rotational direction when the actuator tilts the screen in the first rotational direction.

* * * * *